US008205778B2

(12) United States Patent
Wang

(10) Patent No.: US 8,205,778 B2
(45) Date of Patent: Jun. 26, 2012

(54) NAILING DEVICE ADAPTED FOR NAIL UNITS OF DIFFERENT SIZES

(75) Inventor: Rong-Yu Wang, Tali (TW)

(73) Assignee: Apex Mfg. Co. Ltd, Tali (TW)

( * ) Notice: Subject to any disclaimer, the term of this patent is extended or adjusted under 35 U.S.C. 154(b) by 293 days.

(21) Appl. No.: 12/700,750

(22) Filed: Feb. 5, 2010

(65) Prior Publication Data

US 2011/0180583 A1 Jul. 28, 2011

(30) Foreign Application Priority Data

Jan. 22, 2010 (TW) ..... 99101733 A

(51) Int. Cl.
*B25C 5/11* (2006.01)

(52) U.S. Cl. ..... 227/109; 227/120; 227/119

(58) Field of Classification Search ..... 227/109, 227/120, 119

See application file for complete search history.

(56) References Cited

U.S. PATENT DOCUMENTS

| | | | | |
|---|---|---|---|---|
| 3,734,377 | A * | 5/1973 | Munn | 227/120 |
| 4,197,974 | A * | 4/1980 | Morton et al. | 227/8 |
| 4,598,852 | A * | 7/1986 | Olesen | 227/119 |
| 5,931,364 | A * | 8/1999 | Dennis | 227/109 |
| 6,082,604 | A * | 7/2000 | Dennis | 227/8 |
| 6,679,414 | B2 * | 1/2004 | Rotharmel | 227/120 |

* cited by examiner

*Primary Examiner* — Brian D Nash

(57) ABSTRACT

A nailing device of the present invention mainly includes a main body, a striker, an actuator, a resilient member, a nail slot, a magazine, a guider, an adjuster and a controlling means. The magazine has a main rail and a sub rail parallel to the main rail, and the main rail is substantially as tall as the sub rail. The adjuster has a protrusive portion having a guiding surface facing the magazine. The guiding surface is vertically formed with two parallel longitudinal grooves and has a bottom end. The longitudinal grooves extend toward the bottom end. The controlling means is for selectively pushing the adjuster to flush the guiding surface with a step surface of the guider.

14 Claims, 8 Drawing Sheets

10
11

60
62
50
61
40
80
83
82
81

70
71
93
52
51
81
110
83
20
21
80
94
91
92
93
90
100
101

NAILING DEVICE ADAPTED FOR NAIL UNITS OF DIFFERENT SIZES

BACKGROUND OF THE INVENTION

1. Field of the Invention

The present invention relates to a mechanical nailing device, and more particularly to a nailing device adapted for nail units of different sizes.

2. Description of the Prior Art

A nailing device is mainly used to strike a nail into an object, and commonly includes a main body, an actuator, a striker and a magazine. A user of the nailing device can presses the actuator to lift the striker, thereafter the striker can rebound quickly to strike one of the nails in the magazine.

However, how to provide a nailing device that is adapted for nail units of different sizes so as to accommodate different situations is still to be solved.

Besides, how to push the nail units of different sizes to smoothly slide along the magazine without jam is still of concern.

SUMMARY OF THE INVENTION

The main object of the present invention is to provide a nailing device adapted for nail units of different sizes.

Another main object of the present invention is to provide a nailing device that the nail units disposed therein can be pushed smoothly and positioned steadily.

To achieve the above and other objects, a nailing device of the present invention includes a main body, a striker, an actuator, a resilient member, a nail slot, a magazine, a guider, an adjuster and a controlling means. The main body defines a chamber therein. The striker is disposed in the chamber, and the striker is movable between a release position and a potential position. The striker has an abutting surface. The actuator has a pressing portion and a driving portion. The driving portion is inserted into the chamber, and the actuator is adapted to move the striker from the release position to the potential position. The resilient member provides the striker with an elastic force to quickly bring the striker back from the potential position to the release position. The nail slot is disposed in the chamber and includes an upper wall and two side walls. A receiving space is defined between the upper wall and the side walls, and the receiving space has an opening facing downward. The magazine is disposed in the receiving space and has a main rail and a sub rail parallel to the main rail. The main rail is substantially as tall as the sub rail. The main rail has a first main side face and a second main side face. The sub rail has a first sub side face and a second sub side face. The first main side face faces the first sub side face, and the second main side face and the second sub side face the two side walls respectively. The first side face is stepped and includes a first upper sub side face and a first bottom sub side face. The first bottom sub side face is closer to the first main side face than the first upper sub side face. A first gap is defined between the first main side face and the first bottom sub side face. A second gap is defined between the second main side face and its corresponding side wall. A third gap is defined between the second sub side face and its corresponding side wall. The guider is disposed in front of the magazine. The guider has two leg portions extending downward. At least one of the leg portions is formed with a step surface. The step surface faces the magazine and is adapted for the abutting surface to abut thereagainst and for the striker to slide therealong. A longitudinal slot is formed between the leg portions. The adjuster has a protrusive portion locating in the longitudinal slot. The protrusive portion has a guiding surface facing the magazine. The guiding surface is vertically formed with two parallel longitudinal grooves and has a bottom end. The longitudinal grooves extend toward the bottom end, and the longitudinal grooves correspond to the first and second gaps respectively. The controlling means is for selectively pushing the adjuster to flush the guiding surface with the step surface.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figures 1, 1A, 1B, 1C:
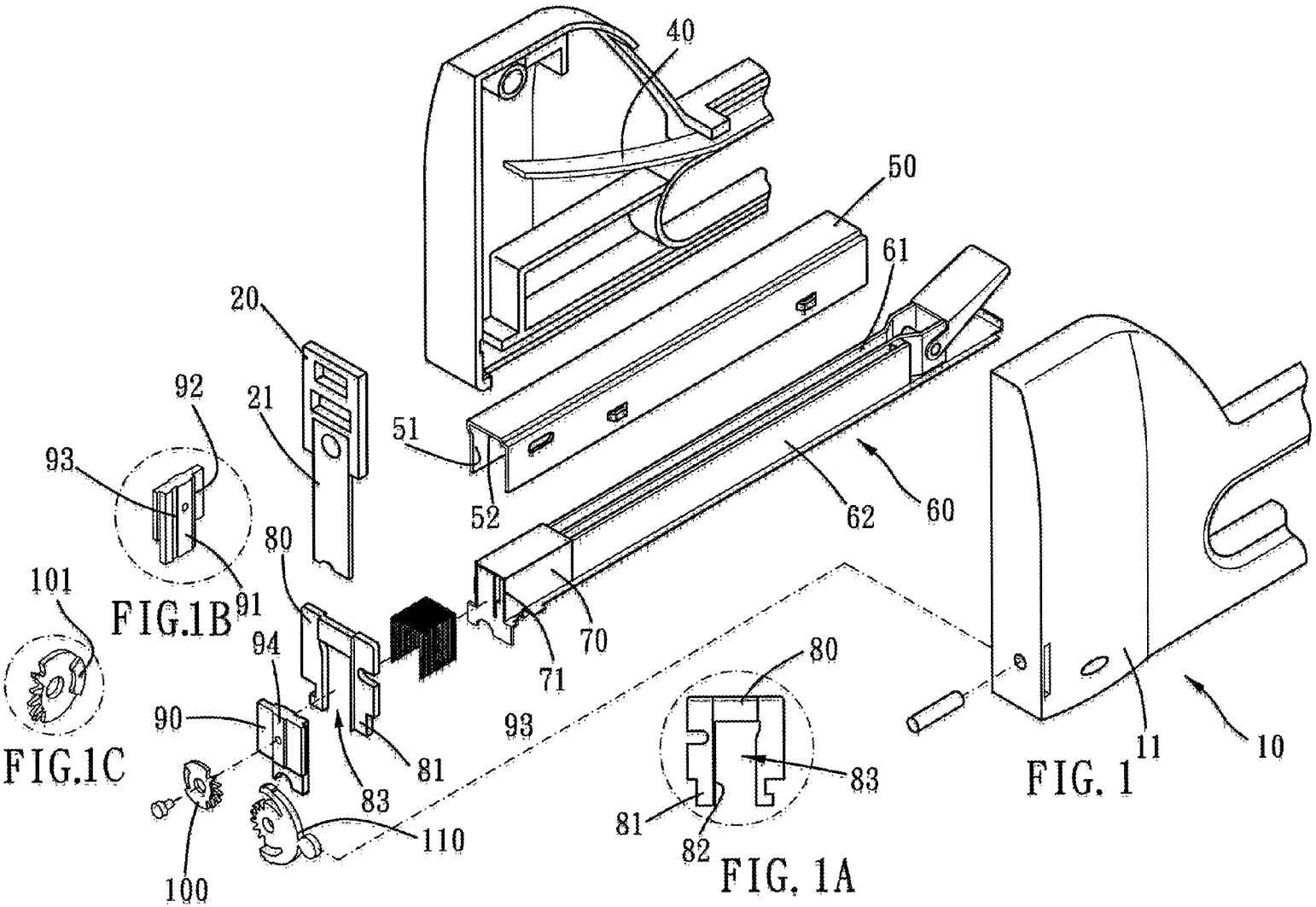
FIG. 1 is a breakdown drawing showing a first embodiment of the present invention.
FIG. 1A is a perspective view showing a guider of the present invention at another angle of view.
FIG. 1B is a perspective view showing an adjuster of the present invention at another angle of view.
FIG. 1C is a rear view showing a rotary wheel of the present invention.
Figure 2:
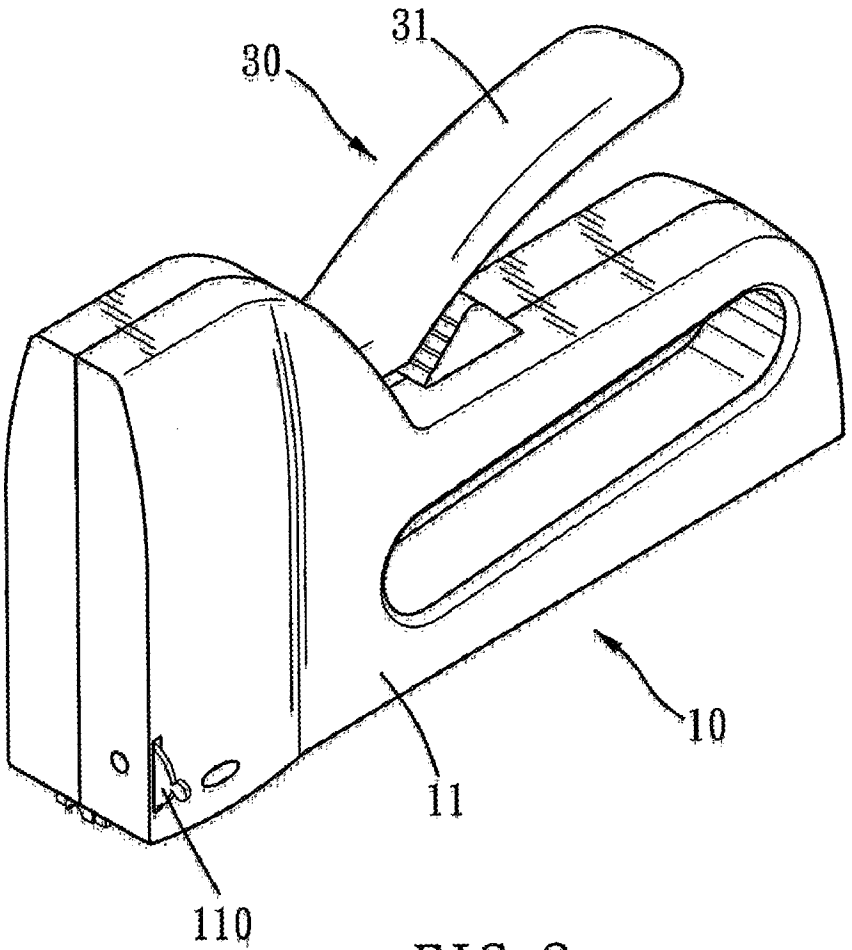
FIG. 2 is a perspective view showing a first embodiment of the present invention.

Please refer to FIG. 1 and FIG. 2 first. In a first embodiment of the present invention, a nailing device includes a main body 10, a striker 20, an actuator 30, a resilient member 40, a nail slot 50, a magazine 60, a nail pusher 70, a guider 80, an adjuster 90 and a controlling means.

The main body 10 substantially consists of two shells 11 fitted together. A chamber is defined between the shells 11. The main body 10 has a bottom opening communicating with the chamber.

The striker 20 is disposed in the chamber and is adapted to strike a nail unit out of the chamber. The striker 20 is thus movable between a release position and a potential position. The striker 20 has an abutting surface facing the guider 80.

The actuator 30 has a pressing portion 31 and a driving portion. The driving portion is inserted into the chamber, and the actuator 30 is adapted to move the striker 20 from the release position to the potential position. More specifically, the driving portion pulls the striker 20 up to the potential position as the pressing portion 31 is pressed downward by the user.

The resilient member 40 provides the striker 20 with an elastic force to quickly bring the striker 20 back from the potential position to the release position so that the striker 20 will have sufficient kinetics to strike a nail unit into an object. In the present embodiment, the resilient member 40 is a leaf spring and is disposed in the chamber. Yet the resilient member 40 may also be a coil spring or other spring.

The nail slot 50 is fixed disposed at a bottom of the chamber. The nail slot 50 includes an upper wall 52 and two side walls 51, and a receiving space is defined between the upper wall 52 and the two side walls 51. In the present embodiment, the nail slot 50 and the main body 10 are separately formed and then combined together. Yet the nail slot 50 may be integrally formed on the main body 10 in another embodiment of the present invention.

Figure 3:
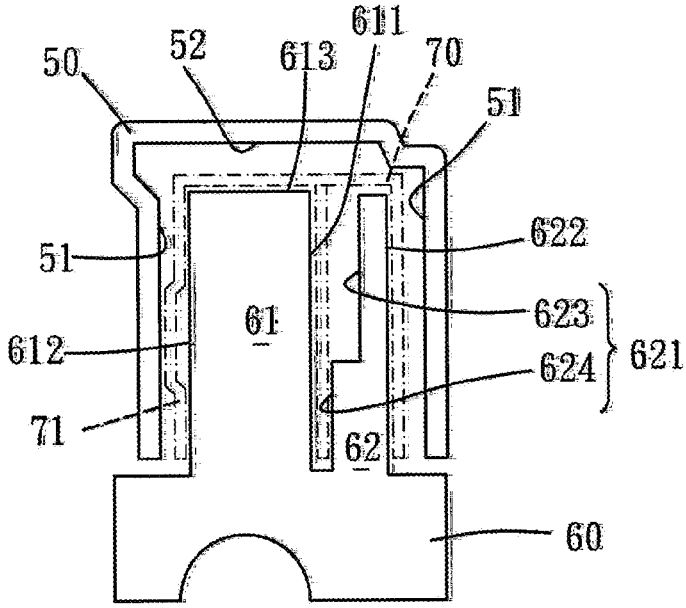
FIG. 3 is a profile showing a nail slot and a magazine of the present invention.
Figure 4:
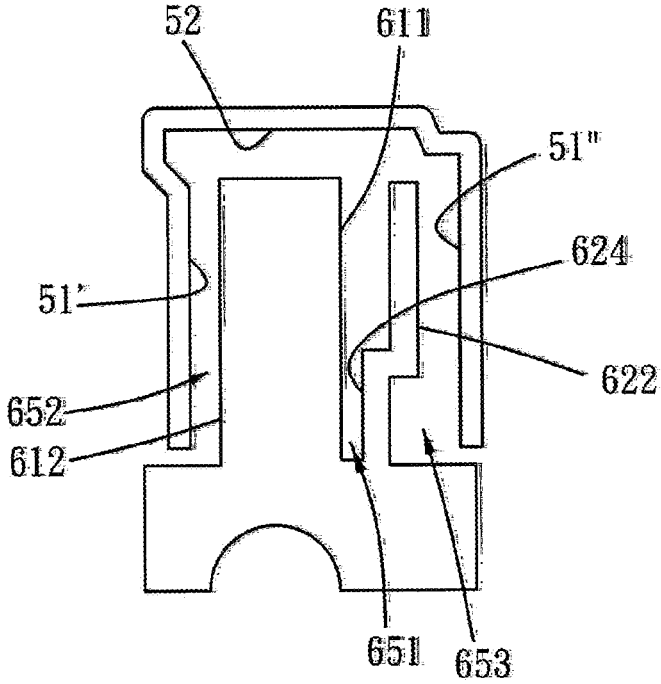
FIG. 4 is a profile showing a nail slot and another magazine of the present invention.

Please further refer to FIG. 3. The magazine 60 is slidably disposed in the receiving space and has a main rail 61 and a sub rail 62 parallel to the main rail 61. The main rail 61 is substantially as tall as the sub rail 62. In the present embodiment, the main rail 61 consists of two plates and has two main side faces, i.e. a first main side face 611 and a second main side face 612, facing outward as shown in FIG. 1. Yet the main rail 61 may be a solid or hollow shank and further have an upper face 613, as shown in FIG. 3. The sub rail 62 has a first sub side face 621 and a second sub side face 622. The first main side face 611 and the first sub side face 621 face each other. The second main side face 612 and the second sub side face 622 face the two side walls 51 respectively. The first sub side face 621 is stepped and includes a first upper sub side face 623 and a first bottom sub side face 624. The first bottom sub side face 624 is closer to the first main side face 611 than the first upper sub side face 623. In the present invention, the sub rail 62 may be formed integrally, consist of a tall plate and a short plate fitted together, or consist of a single plate undergone a stamping procedure, as shown in FIG. 4. Thereby, the stepped first sub side face 621 is formed, and the second sub side face 622 is correspondingly formed in a stepped shape compensating for the first sub side face 621. As such, the material needed to form the sub rail 62 can be reasonably reduced.

As best shown in FIG. 4, a first gap 651 is defined between the first main side face 611 and a first bottom sub side face 624, a second gap 652 is defined between the second main side face 612 and its corresponding side wall 51', and a third gap 653 is defined between the second sub side face 622 and its corresponding side wall 52".

The nail pusher 70 is straddled on the magazine 60, and it has three pushing legs 71 inserting into the first, second and third gaps 651, 652 and 653, so as to push the nail units toward the striker 20. The nail pusher 70 is preferably driven by an elastic force, which may be provided by an elastic member such as a spring.

Please further refer to FIG. 1A. The guider 80 is disposed in front of the magazine 60 and has two leg portions 81 extending downward. At least one of the leg portions 81 is formed with a step surface 82, which faces the magazine 60 and is adapted for the abutting surface 21 to abut thereagainst and for the striker 20 to slide therealong. A longitudinal slot 83 is formed between the leg portions 81.

Please further refer to FIG. 1B. The adjuster 90 has a protrusive portion locating in the longitudinal slot 83, i.e. between the leg portions 81. The protrusive portion has a guiding surface 91 facing the magazine 60. The guiding surface 91 is vertically formed with two parallel longitudinal grooves 92 and 93 and has a bottom end. The longitudinal grooves 92 and 93 extend toward the bottom end, and the grooves 92 and 93 correspond to the first and second gaps 651 and 652 respectively.

Figure 6:
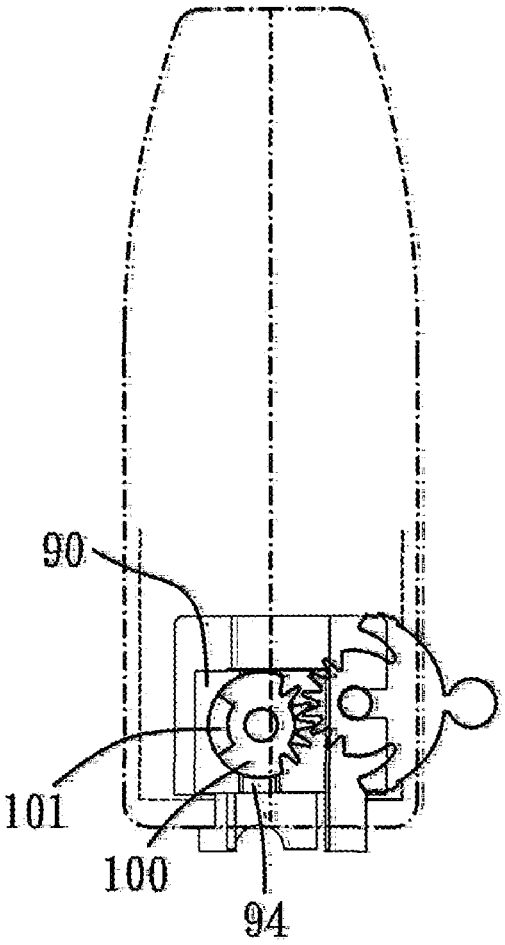
FIG. 6 is another transparent view showing a nailing device of the present invention.
Figure 5:
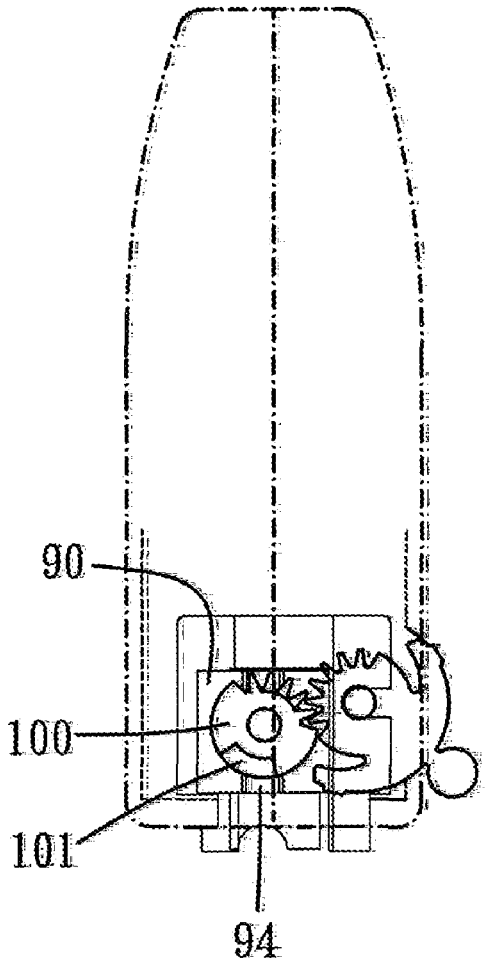
FIG. 5 is a front transparent view showing a nailing device of the present invention.
Figures 7, 7A:
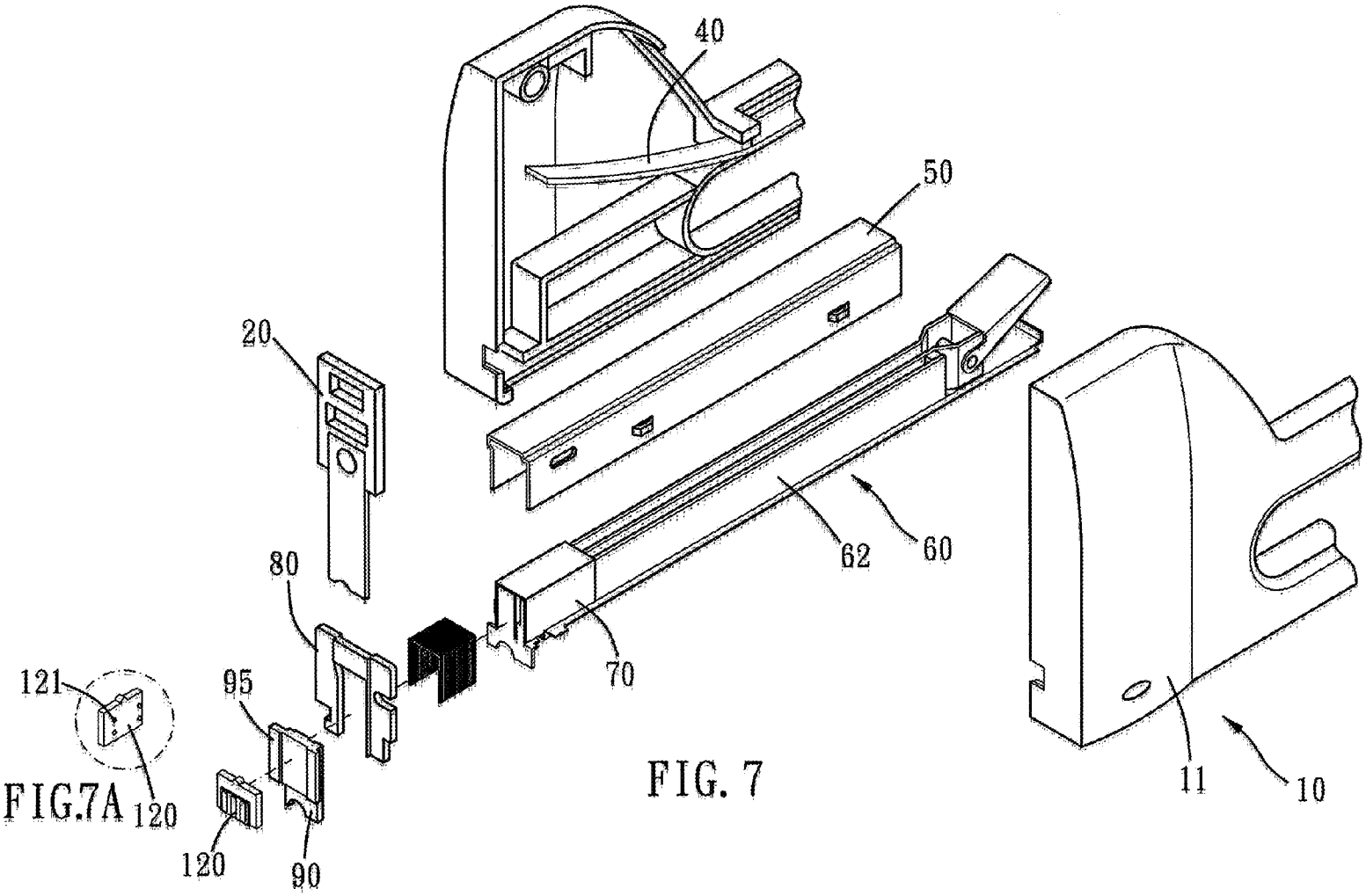
FIG. 7 is a breakdown view showing a second embodiment of the present invention.
FIG. 7A is a perspective view showing a controller of the present invention at another angle of view.

The controlling means is for selectively pushing the adjuster 90 to flush the guiding surface 91 with the step surface 82. In the present embodiment, the controlling means includes a rotary wheel 100 and a controller 110. The controller 110 is adapted for the user to switch, so as to drive the rotary wheel 100 to rotate. At least one protrusive boss 101, 94 is respectively formed on surfaces of the rotary wheel 100 and the adjuster 90 which face each other, as further shown in FIG. 1C. As shown in FIG. 5, when the rotary wheel 100 is rotated so that the bosses 101, 94 abut against each other, the adjuster 90 is pushed toward the magazine 60, and the guiding surface 91 is flush with the step surface 82. As shown in FIG. 6, when the rotary wheel 100 is rotated reversely so that the boss 101 disengages from the boss 94, the adjuster 90 is pushed away from the magazine 60 by the force provided by the nail pusher 70. As such, the guiding surface 91 does not flush with the step surface 82 and is sunk in the longitudinal slot 83. In other wards, the controlling means simply includes at least one protrusive surface selectively abutting against another surface to adjust the position of the adjuster 90. For instance, in another embodiment as shown in FIG. 7, the controlling means merely includes a transversely movable controller 120. The controller 120 also has a protrusive boss 121 that can be selectively abut against a protrusive surface 95 of the adjuster 90, so that the position of the adjuster 90 can be adjusted.

Please refer to FIG. 8 to FIG. 11. In the present invention, the magazine 60 is adapted for T-shaped nails 130, U-shaped cable staples 140, thicker staples 150 and thinner staples 160. Due to the size, such as the width, differences between the nail units, the adjuster 90 has to be appropriately adjusted to prevent the striker 20 from hitting multiple nail units at a single strike, since the striker 20 is mainly designed to strike one nail unit at a time.

Figure 8:
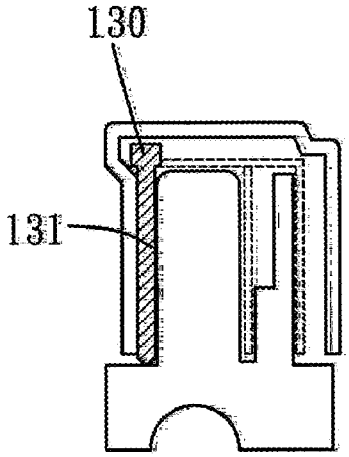
FIG. 8 is a profile showing a nail slot and a magazine of the present invention being disposed with T-shaped nails.
Figure 12:
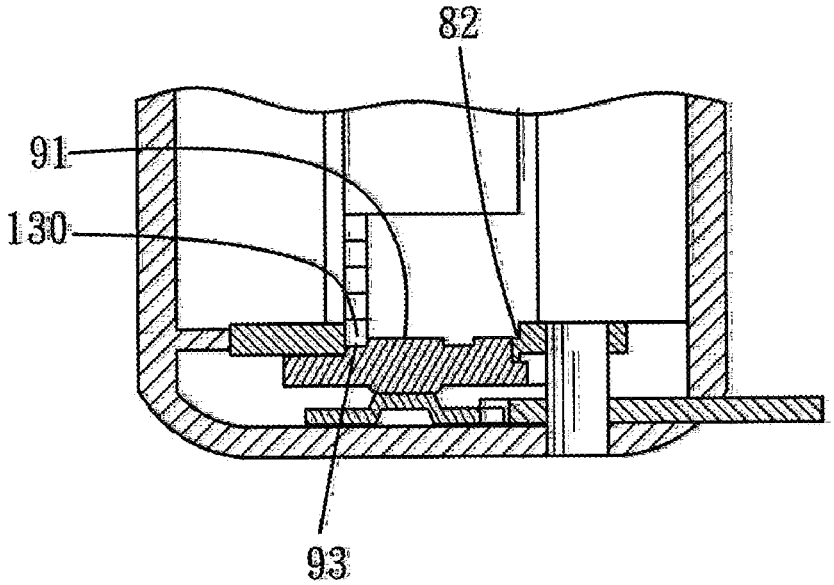
FIG. 12 is a profile showing a nailing device of the present invention being disposed with T-shaped nails.

Please refer to FIG. 8 and FIG. 12. When the T-shaped nails 130 are received in the magazine 60, legs 131 of the T-shaped nails 130 are located in the second gap 652. Meanwhile, the guiding surface 91 is flush with the step surface 82, and the longitudinal groove 93 corresponding to the second gap 652 is adapted for the leg 131 of the first T-shaped nail to abut thereagainst. As such, only the first T-shaped nail 130 will be struck by the striker 20. Further, the longitudinal groove 93 can guide the first T-shaped nail to be vertically struck into an object.

Figure 9:
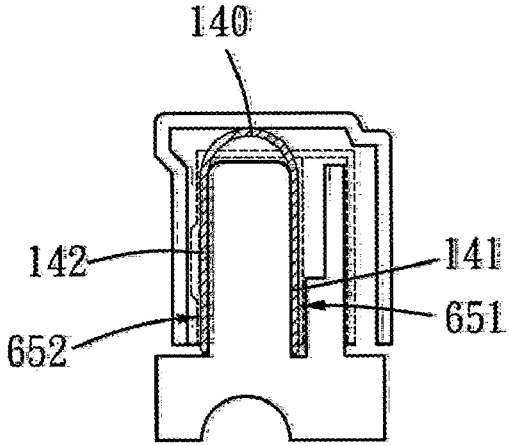
FIG. 9 is a profile showing a nail slot and a magazine of the present invention being disposed with U-shaped cable staples.
Figure 13:
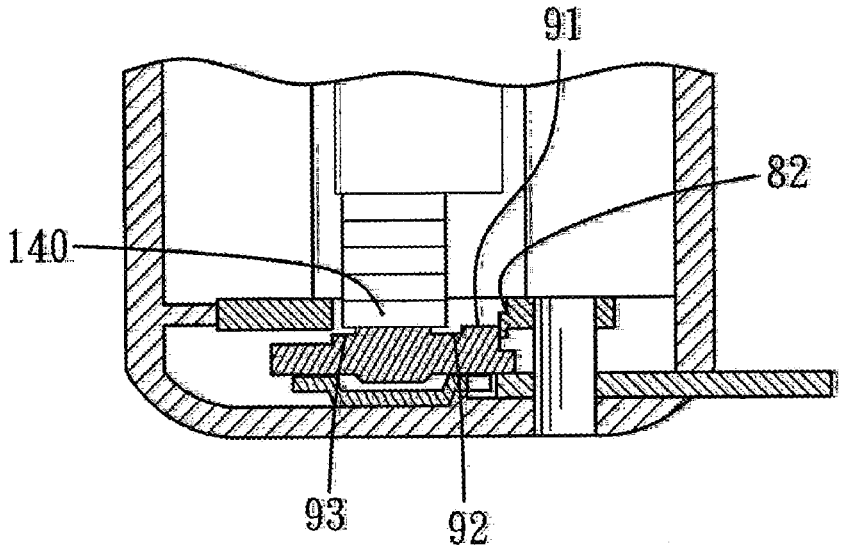
FIG. 13 is a profile showing a nailing device of the present invention being disposed with U-shaped cable staples.

Please refer to FIG. 9 and FIG. 13. Each of the U-shaped cable staples 140 has two legs 141 and 142. When the U-shaped cable staples 140 are received in the magazine 60, the legs 141 and 142 of each U-shaped cable staple 140 are located in the first and second gaps 651 and 652 respectively. The guiding surface 91 is slightly sunk into the longitudinal slot 83 and does not flush with the step surface 82. Because each of the U-shaped cable staples 140 have a bigger width, the striker 20 can strike only one U-shaped cable staples 140 at a time under such circumstance. Also, the longitudinal slots 92 and 93 can vertically guide the legs 141 and 142 as the U-shaped cable staple 140 is struck.

Figure 10:
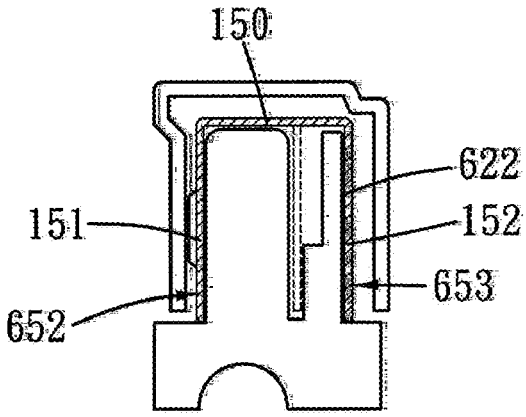
FIG. 10 is a profile showing a nail slot and a magazine of the present invention being disposed with thicker staples.
Figure 14:
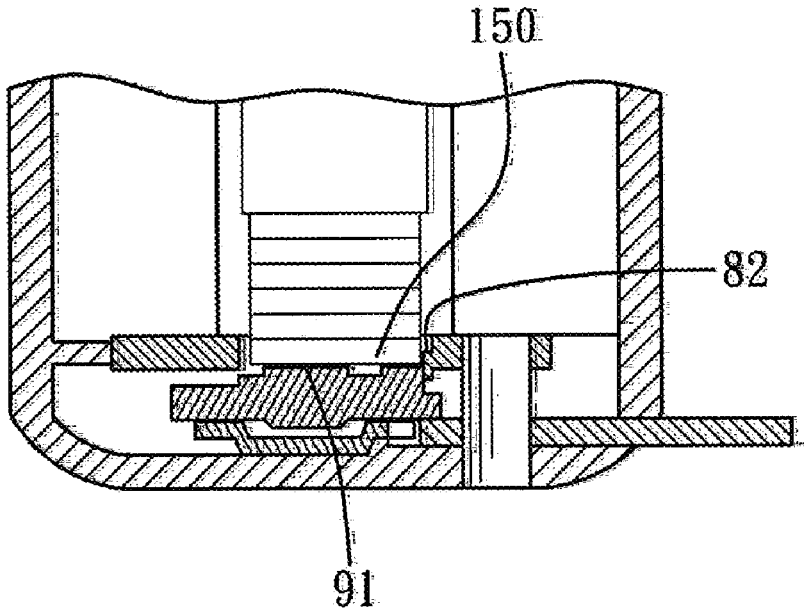
FIG. 14 is a profile showing a nailing device of the present invention being disposed with thicker staples.

Please refer to FIG. 10 and FIG. 14. Likewise, when the thicker staples 150 are received in the magazine 60, the guiding surface 91 is slightly sunk into the longitudinal slot 83 and does not flush with the step surface 82. As such, the striker 20 is adapted to strike a single thicker staple 150 at a time. Legs 151 and 152 of each thicker staple 150 are located in the second and third gaps 652 and 653 respectively.

Figure 11:
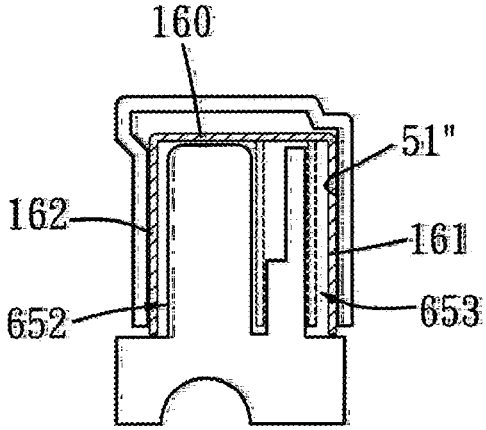
FIG. 11 is a profile showing a nail slot and a magazine of the present invention being disposed with thinner staples.
Figure 15:
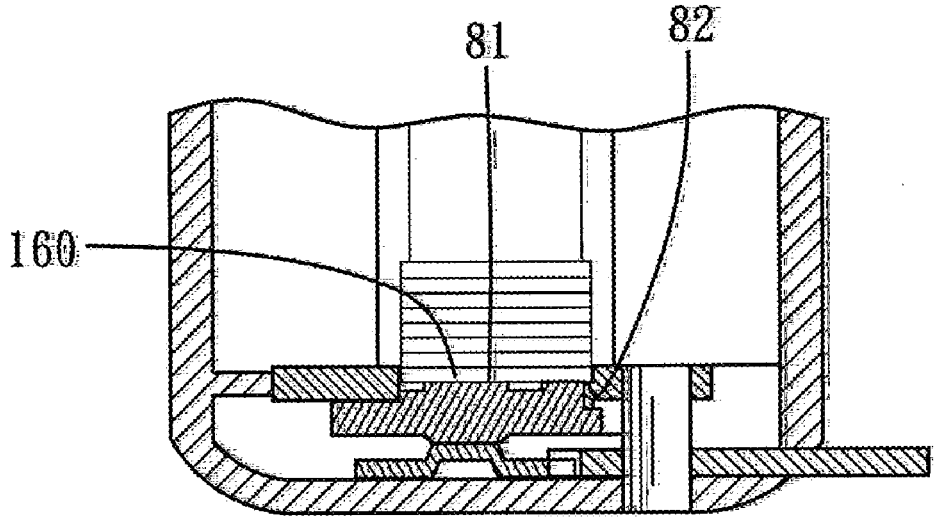
FIG. 15 is a profile showing a nailing device of the present invention being disposed with thinner staples.

Please refer to FIG. 11 and FIG. 15. When the thinner staples 160 are received in the magazine 60, the adjuster 90 is pushed toward the magazine 60 and the guiding surface 91 flushes with the step surface 82 because the width of the thinner staples 160 is smaller. As such, the striker 20 can strike only one thinner staple 160 at a time. Legs 161 and 162 are located in the second and third gaps 652 and 653 respectively. Further, the leg 162 of the thinner staple 160 leans against the step surface 82 and is vertically guided by the step surface 82 when the thinner staple 160 is struck by the striker 20.

A total width of the thinner staples 160 may be bigger than that of the thicker staples 150. Preferably, a width of the third gap 653 is no smaller than 1.5 times that of the legs 152 of the thicker staples 150, so that the magazine 60 is adapted to receive staples with different widths. Furthermore, the legs 152 of the thicker staples 150 lean against the second sub side face 622, and the legs 162 of the thinner staples 160 lean against the side wall 51" corresponding to the second sub side face 622. As such, the staples of different size can be properly guided to prevent nail jamming.

What is claimed is:

1. A nailing device adapted for nail units of different sizes, comprising:

a main body, defining a chamber therein;

a striker, disposed in the chamber, the striker being movable between a release position and a potential position, the striker having an abutting surface;

an actuator, having a pressing portion and a driving portion, the driving portion being inserted into the chamber, the actuator being adapted to move the striker from the release position to the potential position;

a resilient member, providing the striker with an elastic force to quickly bring the striker back from the potential position to the release position;

a nail slot, disposed in the chamber, the nail slot comprising an upper wall and two side walls, a receiving space being defined between the upper wall and the two side walls, the receiving space having an opening facing downward;

a magazine, disposed in the receiving space, the magazine having a main rail and a sub rail parallel to the main rail, the main rail being substantially as tall as the sub rail, the main rail having a first main side face and a second main side face, the sub rail having a first sub side face and a second sub side face, the first main side face facing the first sub side face, and the second main side face and the second sub side face facing the two side walls respectively, the first sub side face being stepped and comprising a first upper sub side face and a first bottom sub side face, the first bottom sub side face being closer to the first main side face than the first upper sub side face, a first gap being defined between the first main side face and the first bottom sub side face, a second gap being defined between the second main side face and its corresponding side wall, a third gap being defined between the second sub side face and its corresponding side wall;

a guider, disposed in front of the magazine, the guider having two leg portions extending downward, at least one of the leg portions being formed with a step surface, the step surface facing the magazine and being adapted for the abutting surface to abut thereagainst and for the striker to slide therealong, a longitudinal slot being formed between the leg portions;

an adjuster, having a protrusive portion locating in the longitudinal slot, the protrusive portion having a guiding surface facing the magazine, the guiding surface being vertically formed with two parallel longitudinal grooves and having a bottom end, the longitudinal grooves extending toward the bottom end, the longitudinal grooves corresponding to the first and second gaps respectively;

an controlling means for selectively pushing the adjuster to flush the guiding surface with the step surface.

2. The nailing device of claim 1, wherein the magazine is adapted to receive T-shaped nails, U-shaped cable staples, thicker staples or thinner staples.

3. The nailing device of claim 2, wherein when the T-shaped nails are received in the magazine, legs of the T-shaped nails are located in the second gap, the guiding surface is flush with the step surface, and the longitudinal groove corresponding to the second gap is adapted for the leg of the first T-shaped nail to abut thereagainst.

4. The nailing device of claim 2, wherein each of the U-shaped cable staples has two legs, when the U-shaped cable staples are received in the magazine, the legs of each U-shaped cable staple are located in the first and second gaps respectively, the guiding surface is slightly sunk into the longitudinal slot and does not flush with the step surface.

5. The nailing device of claim 2, wherein each of the thicker staples has two legs, when the thicker staples are received in the magazine, the legs of the thicker staples are located in the second and third gaps respectively, the guiding surface is slightly sunk into the longitudinal slot and does not flush with the step surface.

6. The nailing device of claim 5, wherein one of the legs of each thicker staple which is located at the third gap leans against the second sub side face.

7. The nailing device of claim 6, wherein a width of the third gap is no smaller than 1.5 times that of the legs of the thicker staples, a total width of the thinner staples is bigger than that of the thicker staples.

8. The nailing device of claim 5, wherein a width of the third gap is no smaller than 1.5 times that of the legs of the thicker staples, a total width of the thinner staples is bigger than that of the thicker staples.

9. The nailing device of claim 2, wherein each of the thinner staples has two legs, when the thinner staples are received in the magazine, the legs of the thinner staples are located in the second and third gaps respectively, the guiding surface is flush with the step surface, and at least one of the legs of the first thinner staple abuts against the at least one step surface.

10. The nailing device of claim 9, wherein one of the legs of each thinner staple which is located at the third gap leans against the side wall corresponding to the second sub side face.

11. The nailing device of claim 10, wherein a width of the third gap is no smaller than 1.5 times that of the legs of the thicker staples, a total width of the thinner staples is bigger than that of the thicker staples.

12. The nailing device of claim 9, wherein a width of the third gap is no smaller than 1.5 times that of the legs of the thicker staples, a total width of the thinner staples is bigger than that of the thicker staples.

13. The nailing device of claim 1, wherein the stepped first sub side face is formed in a stamping manner, and the second sub side face is correspondingly formed in a stepped shape compensating for the first sub side face.

14. The nailing device of claim 1, further comprising a nail pusher straddled on the magazine, the nail pusher having three pushing legs inserting into the first, second and third gaps respectively.

* * * * *